US011293382B2

(12) United States Patent
Mastbergen

(10) Patent No.: US 11,293,382 B2
(45) Date of Patent: Apr. 5, 2022

(54) PASSIVE PUMPING FOR RECIRCULATING EXHAUST GAS

(71) Applicant: Woodward, Inc., Fort Collins, CO (US)

(72) Inventor: Daniel B. Mastbergen, Loveland, CO (US)

(73) Assignee: Woodward, Inc., Fort Collins, CO (US)

( * ) Notice: Subject to any disclaimer, the term of this patent is extended or adjusted under 35 U.S.C. 154(b) by 0 days.

(21) Appl. No.: 17/143,858

(22) Filed: Jan. 7, 2021

(65) Prior Publication Data

US 2021/0207560 A1 Jul. 8, 2021

Related U.S. Application Data

(60) Provisional application No. 62/958,645, filed on Jan. 8, 2020.

(51) Int. Cl.

| | |
|---|---|
| ***F02M 26/19*** | (2016.01) |
| ***F02M 26/04*** | (2016.01) |
| ***F02M 26/09*** | (2016.01) |
| ***F02M 26/22*** | (2016.01) |

(52) U.S. Cl.

CPC ..... *F02M 26/19* (2016.02); *F02M 26/04* (2016.02); *F02M 26/09* (2016.02); *F02M 26/22* (2016.02)

(58) Field of Classification Search

CPC ..... F02M 26/19; F02M 26/04; F02M 26/09; F02M 26/22

USPC ..... 60/605.2

See application file for complete search history.

(56) References Cited

U.S. PATENT DOCUMENTS

| | | | | |
|---|---|---|---|---|
| 2,354,179 | A | 7/1944 | Blanc | |
| 3,680,534 | A | 8/1972 | Chavant | |
| 3,915,222 | A * | 10/1975 | Hull | F28C 3/02 165/111 |
| 4,069,797 | A | 1/1978 | Nohira et al. | |
| 4,167,165 | A * | 9/1979 | Finlay | F02M 31/093 123/545 |
| 4,183,333 | A | 1/1980 | Aoyama | |

(Continued)

FOREIGN PATENT DOCUMENTS

| | | |
|---|---|---|
| CN | 202125377 | 1/2012 |
| CN | 203335295 | 12/2013 |

(Continued)

OTHER PUBLICATIONS

An English Machine Translation to Enzendorfer et al. (Pub. No. DE 198 57 577A1), published on Jul. 1, 1999.*

(Continued)

*Primary Examiner* — Jesse S Bogue

(74) *Attorney, Agent, or Firm* — Fish & Richardson P.C.

(57) ABSTRACT

Multiple convergent nozzles define multiple flow passages in a flow path from an air inlet of the mixer to an outlet of the mixer. The convergent nozzles each converge toward the outlet of the mixer. An exhaust gas housing includes an exhaust gas inlet leading into an interior of the exhaust gas housing. Multiple convergent-divergent nozzles each correspond to one of the plurality of convergent nozzles. The convergent-divergent nozzles each include an air-exhaust gas inlet in fluid communication to receive fluid flow from a corresponding convergent nozzle and the interior of the exhaust gas housing.

21 Claims, 5 Drawing Sheets

(56) References Cited

U.S. PATENT DOCUMENTS

| | | | | |
|---|---|---|---|---|
| 4,203,400 | A | 5/1980 | Yorioka | |
| 4,249,503 | A | 2/1981 | Noguchi et al. | |
| 4,271,795 | A | 6/1981 | Nakagawa et al. | |
| 5,611,203 | A | 3/1997 | Henderson et al. | |
| 5,611,204 | A | 3/1997 | Radovanovic et al. | |
| 5,974,802 | A | 11/1999 | Blake | |
| 6,003,316 | A | 12/1999 | Baert et al. | |
| 6,216,458 | B1 | 4/2001 | Alger et al. | |
| 6,267,106 | B1 | 7/2001 | Feucht | |
| 6,343,594 | B1 | 2/2002 | Koeslin et al. | |
| 6,408,833 | B1 | 6/2002 | Faletti | |
| 6,425,382 | B1 | 7/2002 | Marthaler et al. | |
| 6,470,864 | B2 | 10/2002 | Kim et al. | |
| 6,609,373 | B2 | 8/2003 | Coleman et al. | |
| 6,609,374 | B2 | 8/2003 | Feucht et al. | |
| 6,640,542 | B2 | 11/2003 | Coleman et al. | |
| 6,659,092 | B2 | 12/2003 | Coleman et al. | |
| 6,729,133 | B1 | 5/2004 | Sorter et al. | |
| 6,732,524 | B2 | 5/2004 | Sponton | |
| 6,776,146 | B1 | 8/2004 | Ricart-Ugaz et al. | |
| 6,810,725 | B2 | 11/2004 | Henderson et al. | |
| 6,880,535 | B2 * | 4/2005 | Sorter | F02M 26/19 60/614 |
| 6,886,544 | B1 | 5/2005 | Bui | |
| 6,983,645 | B2 | 1/2006 | Webb et al. | |
| 7,032,578 | B2 * | 4/2006 | Liu | F02M 35/10222 123/568.17 |
| 7,040,305 | B2 | 5/2006 | Sponton | |
| 7,140,874 | B2 | 11/2006 | Ingalls, Jr. et al. | |
| 7,175,422 | B2 | 2/2007 | Webb et al. | |
| 7,178,492 | B2 | 2/2007 | Coleman et al. | |
| 7,191,743 | B2 | 3/2007 | Weber et al. | |
| 7,212,926 | B2 | 5/2007 | Ingalls, Jr. et al. | |
| 7,252,077 | B2 | 8/2007 | Berggren | |
| 7,261,096 | B2 | 8/2007 | Berggren et al. | |
| 7,277,801 | B2 | 10/2007 | Webb et al. | |
| 7,281,530 | B2 | 10/2007 | Usei | |
| 7,299,137 | B2 | 11/2007 | Bartley et al. | |
| 7,311,090 | B2 | 12/2007 | Lyons | |
| 7,322,193 | B2 | 1/2008 | Bering et al. | |
| 7,347,086 | B2 | 3/2008 | Webb et al. | |
| 7,389,770 | B2 | 6/2008 | Bertilsson et al. | |
| 7,412,335 | B2 | 8/2008 | Anderson et al. | |
| 7,550,126 | B2 | 6/2009 | Webb et al. | |
| 7,552,722 | B1 * | 6/2009 | Shieh | F02M 26/19 60/602 |
| 7,578,179 | B2 | 8/2009 | Krueger et al. | |
| 7,597,016 | B2 | 10/2009 | Timmons et al. | |
| 7,669,411 | B2 | 3/2010 | Mallampalli et al. | |
| 7,712,314 | B1 | 5/2010 | Barnes et al. | |
| 7,748,976 | B2 | 7/2010 | Burrahm et al. | |
| 7,833,301 | B2 | 11/2010 | Schindler et al. | |
| 7,854,118 | B2 | 12/2010 | Vetrovec | |
| 7,886,727 | B2 | 2/2011 | Ulrey | |
| 7,934,492 | B2 | 5/2011 | Gemm | |
| 8,047,185 | B2 | 11/2011 | Ulrey et al. | |
| 8,056,340 | B2 | 11/2011 | Vaught et al. | |
| 8,061,120 | B2 | 11/2011 | Hwang | |
| 8,425,224 | B2 | 4/2013 | Webb et al. | |
| 8,821,349 | B2 | 9/2014 | Cunningham et al. | |
| 9,051,900 | B2 | 6/2015 | Regner | |
| 9,074,540 | B2 | 7/2015 | Subramanian | |
| 9,239,034 | B2 | 1/2016 | Cunningham et al. | |
| 9,303,557 | B2 | 4/2016 | Ulrey et al. | |
| 9,309,837 | B2 | 4/2016 | Ulrey et al. | |
| 9,448,091 | B2 | 9/2016 | Woodsend | |
| 9,488,098 | B2 | 11/2016 | Sponsky | |
| 9,546,591 | B2 | 1/2017 | Ge | |
| 9,651,004 | B2 | 5/2017 | Zhang | |
| 9,695,785 | B2 | 7/2017 | Roth et al. | |
| 9,816,466 | B2 | 11/2017 | Roth et al. | |
| 9,863,371 | B2 * | 1/2018 | El Gammal | F02M 21/04 |
| 10,036,353 | B2 | 7/2018 | Shuto et al. | |
| 10,161,362 | B2 * | 12/2018 | Zhang | F02M 26/19 |
| 10,316,803 | B2 * | 6/2019 | Hampson | F02M 26/19 |
| 10,634,099 | B2 | 4/2020 | Hampson | |
| 10,995,705 | B2 * | 5/2021 | Mastbergen | F02M 26/19 |
| 10,995,706 | B1 * | 5/2021 | Tan | F02M 26/47 |
| 11,215,132 | B1 * | 1/2022 | Han | F02D 41/0002 |
| 2003/0111065 | A1 | 6/2003 | Blum | |
| 2004/0173192 | A1 | 9/2004 | Sorter et al. | |
| 2005/0247284 | A1 | 11/2005 | Weber et al. | |
| 2006/0021346 | A1 | 2/2006 | Whelan et al. | |
| 2006/0168958 | A1 | 8/2006 | Vetrovec | |
| 2007/0039321 | A1 | 2/2007 | Sheidler | |
| 2010/0300413 | A1 | 12/2010 | Ulrey et al. | |
| 2011/0265772 | A1 | 11/2011 | Teng | |
| 2012/0180478 | A1 | 7/2012 | Johnson et al. | |
| 2013/0276766 | A1 | 10/2013 | Rajkumar | |
| 2013/0319381 | A1 | 12/2013 | Piaz | |
| 2014/0224232 | A1 | 8/2014 | Hotta | |
| 2014/0238364 | A1 | 8/2014 | Beyer et al. | |
| 2015/0047317 | A1 | 2/2015 | Ulrey et al. | |
| 2015/0047618 | A1 | 2/2015 | Ulrey et al. | |
| 2015/0059713 | A1 | 3/2015 | Forshier | |
| 2015/0083085 | A1 | 3/2015 | Ravenhill et al. | |
| 2015/0267650 | A1 | 9/2015 | Siuchta et al. | |
| 2015/0285192 | A1 | 10/2015 | Roth et al. | |
| 2015/0369126 | A1 | 12/2015 | Knopfel et al. | |
| 2016/0319778 | A1 | 11/2016 | Shuto et al. | |
| 2017/0022941 | A1 | 1/2017 | Mallard | |
| 2017/0030305 | A1 | 2/2017 | Sugiyama | |
| 2017/0058839 | A1 | 3/2017 | El Gammal et al. | |
| 2017/0138319 | A1 * | 5/2017 | Zurlo | F02M 26/17 |
| 2017/0306899 | A1 | 10/2017 | Sanami | |
| 2019/0085794 | A1 * | 3/2019 | Zhang | F02M 26/19 |
| 2019/0093604 | A1 | 3/2019 | Hampson | |
| 2019/0257274 | A1 | 8/2019 | Hampson | |
| 2020/0256266 | A1 | 8/2020 | Mastbergen | |

FOREIGN PATENT DOCUMENTS

| | | |
|---|---|---|
| CN | 203499859 | 3/2014 |
| CN | 204386776 | 6/2015 |
| CN | 207920739 | 9/2018 |
| CN | 110630409 | 12/2019 |
| DE | 181618 | 3/1907 |
| DE | 4429232 | 9/1995 |
| DE | 19587578 | 6/1999 |
| DE | 19857577 | 7/1999 |
| DE | 10054264 | 5/2002 |
| DE | 102017119549 | 3/2018 |
| EP | 0653559 | 5/1995 |
| EP | 0732490 | 9/1996 |
| EP | 1020632 B1 | 7/2000 |
| EP | 1859128 B1 | 7/2008 |
| EP | 2562397 | 2/2013 |
| FR | 2902466 | 12/2007 |
| FR | 2893988 B1 | 1/2008 |
| GB | 2313623 | 12/1997 |
| GB | 2356223 | 5/2001 |
| GB | 2421543 | 6/2006 |
| GB | 2438360 | 11/2007 |
| JP | H 09195860 | 7/1997 |
| JP | H 10131742 | 5/1998 |
| JP | H 11324812 | 11/1999 |
| JP | 2000097111 | 4/2000 |
| JP | 2000230460 | 8/2000 |
| JP | 2002221103 | 8/2002 |
| JP | 2004100508 | 4/2004 |
| JP | 2005147010 | 6/2005 |
| JP | 2005147011 | 6/2005 |
| JP | 2005147030 | 6/2005 |
| JP | 2005147049 | 6/2005 |
| JP | 2006132373 | 5/2006 |
| JP | 2007092592 | 4/2007 |
| JP | 2009299591 | 12/2009 |
| JP | 2010101191 | 5/2010 |
| JP | 2013087720 | 5/2013 |
| JP | 2013113097 | 6/2013 |
| JP | 2013170539 | 9/2013 |
| JP | 5530267 | 6/2014 |
| JP | 5916335 | 5/2016 |
| JP | 5935975 | 6/2016 |

(56) References Cited

FOREIGN PATENT DOCUMENTS

| | | |
|---|---|---|
| JP | 5938974 | 6/2016 |
| JP | 6035987 | 11/2016 |
| JP | 6051881 | 12/2016 |
| WO | WO2008013585 | 1/2008 |
| WO | WO2015069330 | 5/2015 |

OTHER PUBLICATIONS

Chinese Office Action in CN Appln. No. 201721556484.3, dated May 14, 2018, 3 pages.
PCT International Search Report and Written Opinion in International Appln. No. PCT/US2018/052637, dated Dec. 21, 2018, 6 pages.
PCT International Search Report and Written Opinion in International Appln. No. PCT/US2020/017155, dated May 27, 2020, 14 pages.
PCT International Search Report and Written Opinion in International Appln. No. PCT/US2021/012654, dated Mar. 17, 2021, 14 pages.

* cited by examiner

PASSIVE PUMPING FOR RECIRCULATING EXHAUST GAS

CROSS-REFERENCE

This disclosure and claims the benefit of priority to U.S. Provisional Patent Application No. 62/958,645, filed Jan. 8, 2020, the contents of which are incorporated by reference herein.

TECHNICAL FIELD

This disclosure relates to exhaust recirculation (EGR) systems for internal combustion engines.

BACKGROUND

Exhaust gas recirculation, especially cooled EGR, can be added to internal combustion engine systems to reduce NOx emissions and reduce knock tendency. In such a system, an amount of exhaust gas is added to the air and/or fuel mixture within the air-intake manifold of the engine. The challenge is that there is a cost to deliver the cooled EGR (cEGR), especially for high efficiency engines which generally are most efficient when the exhaust manifold pressure is lower than the intake manifold pressure. The pressure difference creates a positive scavenging pressure difference across the engine which scavenges burn gas from the cylinder well and provides favorable pressure-volume pumping loop work. It is particularly challenging to deliver cEGR from its source at the exhaust manifold to the intake manifold without negatively impacting the residual gas scavenging and efficiency of the engine cycle via the pumping loop. The "classic" high pressure loop cEGR system plumbs the exhaust gas directly to the intake manifold, which requires either design or variable turbocharging to force the engine exhaust manifold pressure to be higher than the intake manifold, which in turn, unfavorably reduces scavenging of hot burned gases and engine P-V cycle and loses efficiency. It is particularly counterproductive since the purpose of the cEGR is to reduce the knock tendency to improve efficiency and power density. However, this classic method to drive EGR actually increases the knock tendency through residual gas retention and reduces efficiency thru negative pressure work on the engine—in a manner of diminishing returns, i.e., two steps forward to reduce knock with cEGR, but one step back due to how it is pumped, leading to a zero gain point where the cost of driving cEGR counteracts the benefits of delivering it.

SUMMARY

This disclosure describes technologies relating to recirculating exhaust gas.

An example implementation of the subject matter described within this disclosure is an engine exhaust gas recirculation mixer with the following features. Multiple convergent nozzles define multiple flow passages that extend alongside one another in a flow path from an engine intake air inlet of the mixer to an outlet of the mixer. The convergent nozzles each converge toward the outlet of the mixer. An exhaust gas housing includes an exhaust gas inlet leading into an interior of the exhaust gas housing. Multiple convergent-divergent nozzles each correspond to one of the plurality of convergent nozzles. The convergent-divergent nozzles each include an air-exhaust gas inlet in fluid communication to receive fluid flow from a corresponding convergent nozzle and the interior of the exhaust gas housing.

Aspects of the example engine exhaust recirculation mixer, which can be combined with the example engine exhaust recirculation mixer alone or in combination with other aspects, include the following. Inlets of each of the convergent nozzles are in a same, first plane, and corresponding outlets of the convergent nozzles are in a same, second plane.

Aspects of the example engine exhaust recirculation mixer, which can be combined with the example engine exhaust recirculation mixer alone or in combination with other aspects, include the following. The air-exhaust gas inlet of each of the convergent-divergent nozzles is in a same, third plane. The corresponding outlet of each of the convergent-divergent nozzles are in a same, fourth plane.

Aspects of the example engine exhaust recirculation mixer, which can be combined with the example engine exhaust recirculation mixer alone or in combination with other aspects, include the following. The air-exhaust gas inlet of each of the convergent-divergent nozzles is an air-fuel-exhaust gas inlet in communication with a fuel supply into the mixer.

Aspects of the example engine exhaust recirculation mixer, which can be combined with the example engine exhaust recirculation mixer alone or in combination with other aspects, include the following. The fuel supply further includes a fuel supply port positioned upstream of the convergent-divergent nozzle.

Aspects of the example engine exhaust recirculation mixer, which can be combined with the example engine exhaust recirculation mixer alone or in combination with other aspects, include the following. The fuel supply port includes a gaseous fuel supply port.

Aspects of the example engine exhaust recirculation mixer, which can be combined with the example engine exhaust recirculation mixer alone or in combination with other aspects, include the following. Each of the convergent-divergent nozzles are aligned on a same center axis as a corresponding convergent nozzle.

Aspects of the example engine exhaust recirculation mixer, which can be combined with the example engine exhaust recirculation mixer alone or in combination with other aspects, include the following. Each one of the air-exhaust gas inlets is upstream of a corresponding outlet of one the convergent nozzles.

Aspects of the example engine exhaust recirculation mixer, which can be combined with the example engine exhaust recirculation mixer alone or in combination with other aspects, include the following. The convergent nozzles extend at least partially within the exhaust gas housing.

Aspects of the example engine exhaust recirculation mixer, which can be combined with the example engine exhaust recirculation mixer alone or in combination with other aspects, include the following. Each of the air-exhaust gas inlets has a greater area than the corresponding outlet of the corresponding one of the convergent nozzles.

Aspects of the example engine exhaust recirculation mixer, which can be combined with the example engine exhaust recirculation mixer alone or in combination with other aspects, include the following. The convergent nozzles include four convergent nozzles, and the convergent-divergent nozzles include four corresponding convergent-divergent nozzles.

Aspects of the example engine exhaust recirculation mixer, which can be combined with the example engine exhaust recirculation mixer alone or in combination with other aspects, include the following. A divergent portion of the convergent-divergent nozzle diverges no more than 7°.

Aspects of the example engine exhaust recirculation mixer, which can be combined with the example engine exhaust recirculation mixer alone or in combination with other aspects, include the following. Pressure ports are located at a convergent end of each of the convergent nozzles.

An example implementation of the subject matter described within this disclosure is a method with the following features. A velocity of an air flow is increased and a pressure of an engine intake air flow is deceased using a first set of convergent nozzles to form a multiple free jets exiting a corresponding one of the converging nozzles. An engine exhaust flow is drawn downstream of the first plurality of convergent nozzles in response to the decreased pressure of each of the free jets. Each of free jets and the exhaust flow are mixed using a second set of convergent nozzles, downstream of the first set of convergent nozzles, to form a set of mixed flows corresponding to the free jets. Each of the second set of convergent nozzles corresponds with a different one of the first set of convergent nozzles. A pressure of the mixed flows is increased and a velocity of the mixed flows is reduced using a set of divergent nozzles, each corresponding to a different one of the second set of convergent nozzles.

Aspects of the example method, which can be combined with the example method alone or in combination with other aspects, include the following. Mixing one of the free jets and the exhaust flow to form one of the mixed flows includes mixing a portion of the air flow, a portion of the exhaust flow, and a portion of a fuel flow, to form a combustion mixture.

Aspects of the example method, which can be combined with the example method alone or in combination with other aspects, include the following. The fuel flow is supplied upstream of the convergent ends of the first set of convergent nozzles.

Aspects of the example method, which can be combined with the example method alone or in combination with other aspects, include the following. The fuel flow includes a gaseous fuel flow.

Aspects of the example method, which can be combined with the example method alone or in combination with other aspects, include the following. The exhaust flow is directed from an exhaust manifold to a point downstream of the first set of convergent nozzles.

An example implementation of the subject matter described within this disclosure is an engine system with the following features. An engine intake manifold is configured to receive a combustible mixture configured to be combusted within an engine combustion chamber. A throttle is upstream of the intake manifold. The throttle is configured to regulate an air flow into the intake manifold. An exhaust manifold is configured to receive combustion products from the combustion chamber. An exhaust gas recirculation mixer is downstream of the throttle and upstream of an intake manifold. The exhaust gas recirculation mixer includes convergent nozzles that extend alongside one another defining a flow passages in a flow path from an engine air intake air inlet of the mixer to an outlet of the mixer. The convergent nozzles each converge toward the outlet of the mixer. An exhaust gas housing includes an exhaust gas inlet leading into an interior of the exhaust gas housing. A plurality of convergent-divergent nozzles in the flow path each corresponding to one of the plurality of convergent nozzles, the plurality of convergent-divergent nozzles extending alongside one another, the plurality of convergent-divergent nozzles each comprising an air-exhaust gas inlet in fluid communication to receive fluid flow from a corresponding convergent nozzle and the interior of the exhaust gas housing.

Aspects of the example system, which can be combined with the example system alone or in combination with other aspects, include the following. A compressor is upstream of the throttle. The compressor is configured to increase a pressure within the flow path.

Aspects of the example system, which can be combined with the example system alone or in combination with other aspects, include the following. A turbine is downstream of the exhaust manifold. The turbine is coupled to the compressor and configured to rotate the compressor.

Aspects of the example system, which can be combined with the example system alone or in combination with other aspects, include the following. An exhaust gas cooler is positioned within a flow path between the exhaust manifold and the exhaust gas recirculation mixer. The exhaust gas cooler is configured to lower a temperature of the exhaust gas prior to the exhaust gas recirculation mixer.

Particular implementations of the subject matter described herein can have one or more of the following advantages. The exhaust gas recirculation mixer can allow recirculating exhaust gas into a pressurized engine intake, such as in a supercharged or turbocharged engine, when the exhaust gas source is at a lower pressure than the intake. In certain instances, the mixer can enable admission of exhaust gas even when the internal combustion engine is running under high-load and high boost. At such high-load high boost conditions, EGR is needed the most but it is also most difficult to supply the EGR, due to the higher pressure in the intake system over the exhaust. Moreover, the mixer can mitigate high back pressure in the exhaust system, which prevents burned gas from effectively leaving the combustion chamber and, itself, promotes knock. The mixer is a passive pump, relying on the area reduction of the primary gas stream to accelerate the gas to a high velocity. The accelerated gas causes a low pressure using the Bernoulli's effect, followed by the creation of a free jet of the gas into a receiver chamber. The free jet generated low pressure acts as a suction in the receiver chamber, which when connected to the EGR path, manifests as a pressure below the exhaust manifold creating a favorable pressure gradient for the EGR to flow to the lower pressure to admit exhaust gas into the mixer. Following the mixer, the reverse Bernoulli effect converts the high velocity gas mixture to a high pressure when it is decelerated into the engine intake manifold. Thus, it mitigates system efficiency losses attributable to the pumping work needed to operate more conventional EGR systems and the negative scavenging pressures across the engine. The mixer is also quite simple in construction, and needs no working parts to operate. The mixer can also be mechanically designed to have different primary flow nozzles which can be modular (e.g., threaded on/off the change out), interchangeably fitted for a wide range of engine displacement families. Further, the mixer creates internal turbulence that promotes mixing of the EGR, air and fuel. Further, the mixer can receive fuel, and operate to mix the fuel, air and EGR. Thus, some implementations 1) reduce the pressure difference across the engine to drive EGR from the exhaust manifold to the intake manifold—under any back pressure to intake pressure ratio, 2) including the special case when it is desirable to maintain the back pressure equal to or below the intake pressure—which (a)

improves efficiency (due to the reduction of Pumping Mean Effective Pressure (PMEP) and (b) reduces the retention of hot burned gases trapped inside the combustion chamber which themselves increase the very knock tendency that the active cooled EGR is attempting to reduce, (3) the addition of high velocity fuel enhances the Jet and suction effect, (4) can simplify the fuel delivery system by eliminating the pressure regulator and pre-heater circuit since the mixer favors high pressure fuel and cold fuel to cool the EGR using the Joules-Thomson effect (fuel jetting will cause the temperature to drop—which is favorable since cooled EGR and cooled intake air are beneficial to engine operation). By using four barrels, a similar total inlet area and outlet area can be used as compared to a single-barrel exhaust gas recirculation mixer, while reducing the total length of the mixer to be substantially half that of a single-barrel mixer.

The details of one or more implementations are set forth in the accompanying drawings and the description below. Other features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Exhaust gas recirculation (EGR) can have parasitic effects on an engine system, that is, it can reduce the effective power output of an engine system as energy is required to move exhaust gas from an exhaust manifold and into an intake manifold. This is especially problematic on forced induction engines where the intake manifold pressure can be higher than the exhaust manifold pressure. Ironically, EGR is most needed when the intake manifold pressure is high, such as when the engine is running at high load. In the case of a turbo-charged engine, increased back-pressure within the exhaust manifold can also contribute to knock under high loads.

The concepts herein relate to an EGR system that can be used on an internal combustion engine, including a forced induction internal combustion engine. A set of jet pumps arranged in parallel is added to the air intake system of the engine between the throttle and the intake manifold. If a compressor is provided in the intake system, the jet pumps can be placed downstream of the compressor (although it could alternatively be placed upstream of the compressor, too). Air, the primary fluid, flows through a central flow passage of each of the jet pumps from the throttle towards the intake manifold. In a low pressure receiver region within each jet pump, recirculated exhaust gas is added to each air stream from the exhaust manifold. The lower effective pressure in each receiver region allows for a pressure differential to form between the exhaust manifold and the receiver. The reverse Bernoulli Effect recovers the pressure by slowing down the high velocity/low pressure gas to create a pressure in the intake manifold that is equal to or higher than the exhaust manifold. So, at the system level, the jet pumps enable the exhaust gas to flow from the exhaust manifold to the intake manifold even when the exhaust manifold is at a lower pressure. Fuel can be added to the air stream upstream of the convergent end of the convergent nozzles. Turbulence is produced within the jet pumps and downstream of the jet pumps leading to a well-mixed, combustible mixture flowing into the manifold.

Figure 1:
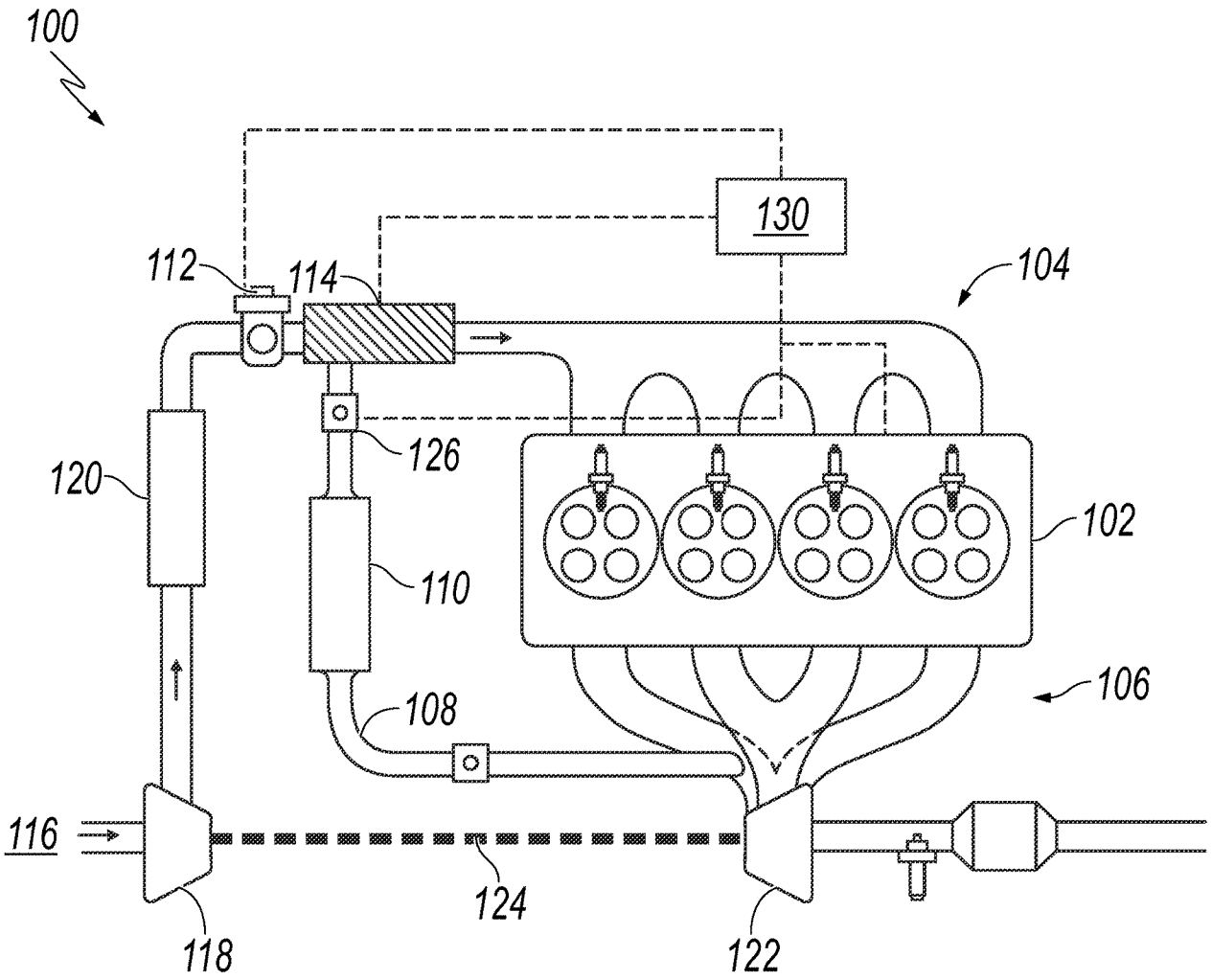
FIG. 1 is a schematic diagram of an example internal combustion engine system.

FIG. 1 shows an example engine system 100. The engine system 100 includes an intake manifold 104 configured to receive a combustible mixture to be combusted within a combustion chamber of the engine 102. That is, the intake manifold is fluidically coupled to a source of oxygen and a source of fuel. The combustible mixture can include air and any combustible fluid, such as natural gas, atomized gasoline, or diesel. While the illustrated implementation includes a four-cylinder engine 102, any number of cylinders can be used. Also, while the illustrated implementation includes a piston engine 102, aspects of this disclosure can be applied to other types of internal combustion engines, such as rotary engines or gas turbine engines.

A throttle 112 is positioned upstream of the intake manifold 104. The throttle 112 is configured to at least partially or entirely regulate an air flow into the intake manifold from the ambient environment 116, for example, by changing a cross-sectional area of a flow passage going through the throttle 112. In some implementations, the throttle 112 can include a butterfly valve or a disc valve. Reducing the cross-sectional area of the flow passage through the throttle 112 reduces the flowrate of air flowing through the throttle 112 towards the intake manifold 104.

An exhaust manifold 106 is configured to receive combustion products (exhaust) from a combustion chamber of the engine 102. That is, the exhaust manifold 106 is fluidically coupled to an outlet of the combustion chamber. An EGR flow passage 108 or conduit fluidically connects the exhaust manifold 106 and the intake manifold 104. In the illustrated implementation, an EGR throttle valve 126 is located within the EGR flow passage 108 between the exhaust manifold 106 and the intake manifold 104 and is used to regulate the EGR flow. The EGR throttle valve 126 regulates the EGR flow by adjusting a cross-sectional area of the EGR flow passage 108 going through the EGR throttle valve 126. In some implementations, the EGR throttle valve 126 can include a butterfly valve, a disc valve, a needle valve, a globe valve, or another style of valve.

The EGR flow passage 108 feeds into an EGR mixer 114 that is located downstream of a throttle 112 and upstream of the intake manifold 104 in the illustrated implementation. The EGR mixer 114 is in the engine intake system, fluidically connected to the throttle 112, the intake manifold 104, and the EGR flow passage 108. The fluid connections can be made with conduits containing flow passages that allow fluid flow. In some implementations, the EGR mixer 114 can be included within a conduit connecting the intake manifold 104 to the throttle 112, within the intake manifold 104 itself, within the EGR flow passage 108, integrated within the throttle 112, or integrated into the EGR throttle valve 126. Details about an example EGR mixer are described throughout this disclosure.

In some implementations, an exhaust gas cooler 110 is positioned in the EGR flow passage 108 between the exhaust manifold 106 and the EGR mixer 114. The exhaust gas cooler 110 can operate to lower a temperature of the exhaust gas prior to the EGR mixer 114. The exhaust gas cooler 110 is a heat exchanger, such as an air-air exchanger or an air-water exchanger. In some implementations, the exhaust gas cooler 110 is not included.

In some implementations, the engine system 100 includes a compressor 118 upstream of the throttle 112. In an engine with a compressor 118 but no throttle, such as an unthrottled diesel engine, the throttle is not needed and the mixer can be down stream of the compressor. The compressor 118 can include a centrifugal compressor, a positive displacement compressor, or another type of compressor for increasing a pressure within the intake manifold 104 during engine operation. In some implementations, the engine system 100 can include an intercooler 120 that is configured to cool the compressed air prior to the air entering the manifold. In the illustrated implementation, the compressor 118 is a part of a turbocharger. That is, a turbine 122 is located downstream of the exhaust manifold 106 and rotates as the exhaust gas expands through the turbine 122. The turbine 122 is coupled to the compressor 118, for example, via a shaft 124, and imparts rotation on the compressor 118. In the illustrated implementation, the turbine 122 also increases a back-pressure within the exhaust manifold 106, thereby increasing the pressure within the EGR flow passage 108. While the illustrated implementation utilizes a turbocharger to increase the pressure within the intake manifold 104, other methods of compression can be used, for example an electric or engine powered compressor (e.g., supercharger). In some implementations, a separate controller 130 or engine control unit (ECU) is used to control various aspects of the system operation. For example, the controller 130 can adjust air-fuel ratios, spark timing, and EGR flow rates based on current operating conditions.

Figure 2:
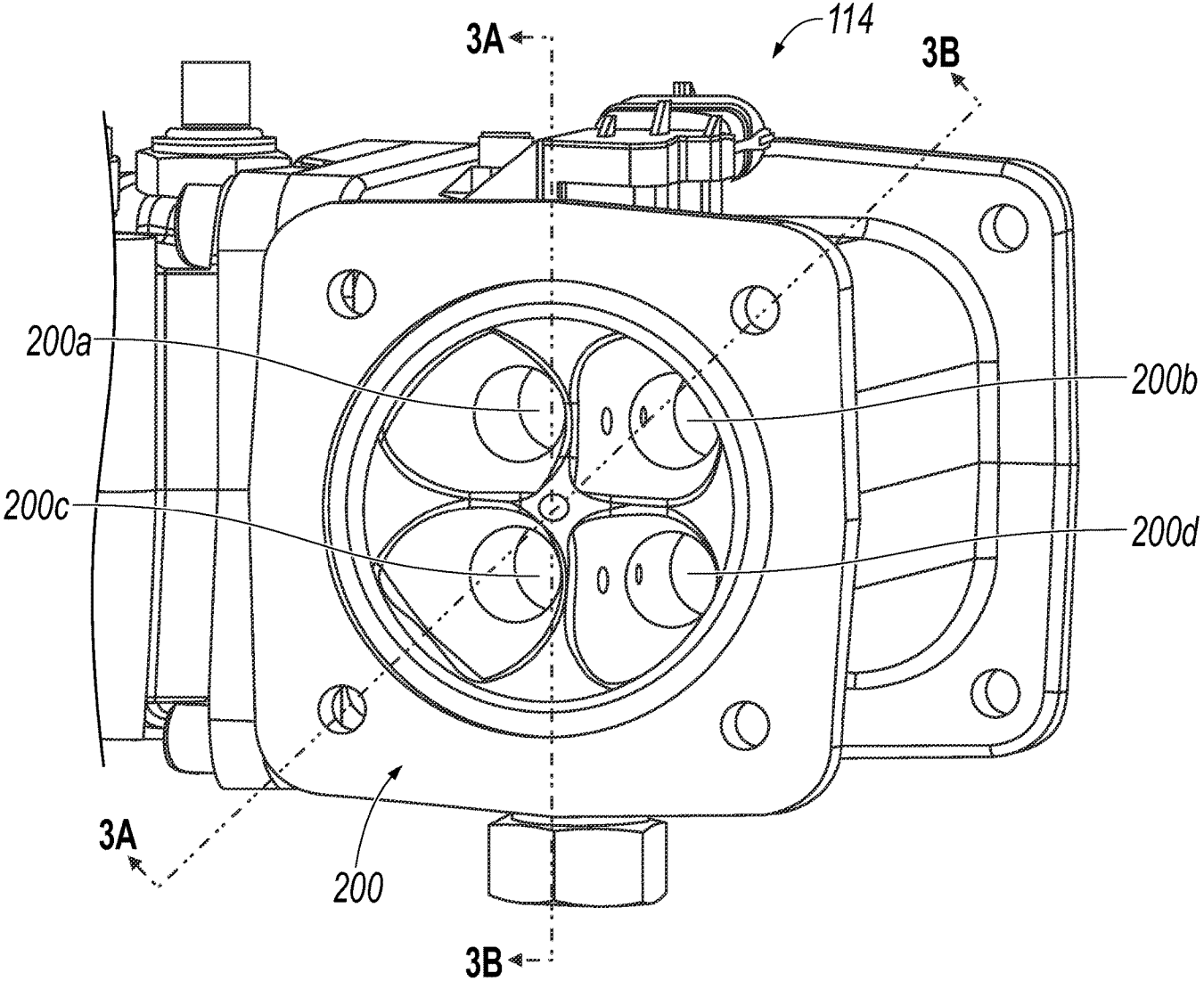
FIG. 2 is a perspective view of an example exhaust gas recirculation mixer.

FIG. 2 is a perspective view of the example exhaust gas recirculation mixer 114. The exhaust gas recirculation mixer 114 includes four jet pumps, or barrels 200, all arranged in parallel. In the illustrated perspective view, barrels 200*a*, 200*b*, 200*c*, and 200*d* are visible. By using four barrels, a similar total inlet area and outlet area can be used as compared to a single-barrel exhaust gas recirculation mixer, while reducing the total length of the exhaust gas recirculation mixer 114 to be substantially half that of a single-barrel mixer. An example single-barrel mixer is described in U.S. Pat. No. 10,316,803, filed on 25 Sep. 2017, which is hereby incorporated by reference. With the single barrel design, there is a fresh air core surrounded by mixed air/EGR. With the multi barrel design described herein, there are multiple fresh air cores, so the fresh air is better divided, distributed, mixed, or otherwise spread prior to entering the engine intake manifold 104. The improved mixing results in a more even distribution of fresh air, EGR, and fuel being distributed among the engine cylinders.

Figure 3A:
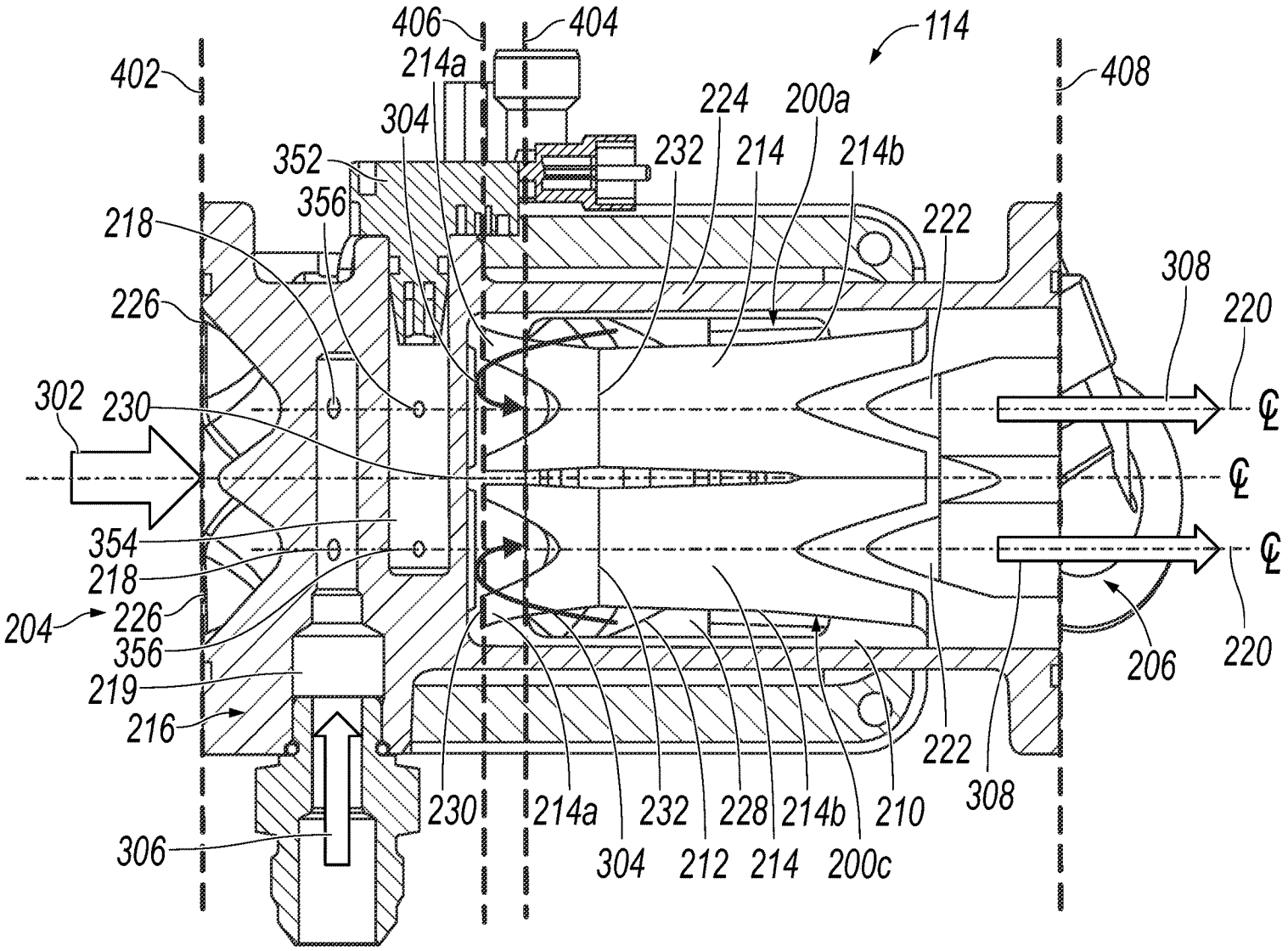
FIG. 3A is a side half cross sectional view of the example exhaust gas recirculation mixer of FIG. 2.
Figure 3B:
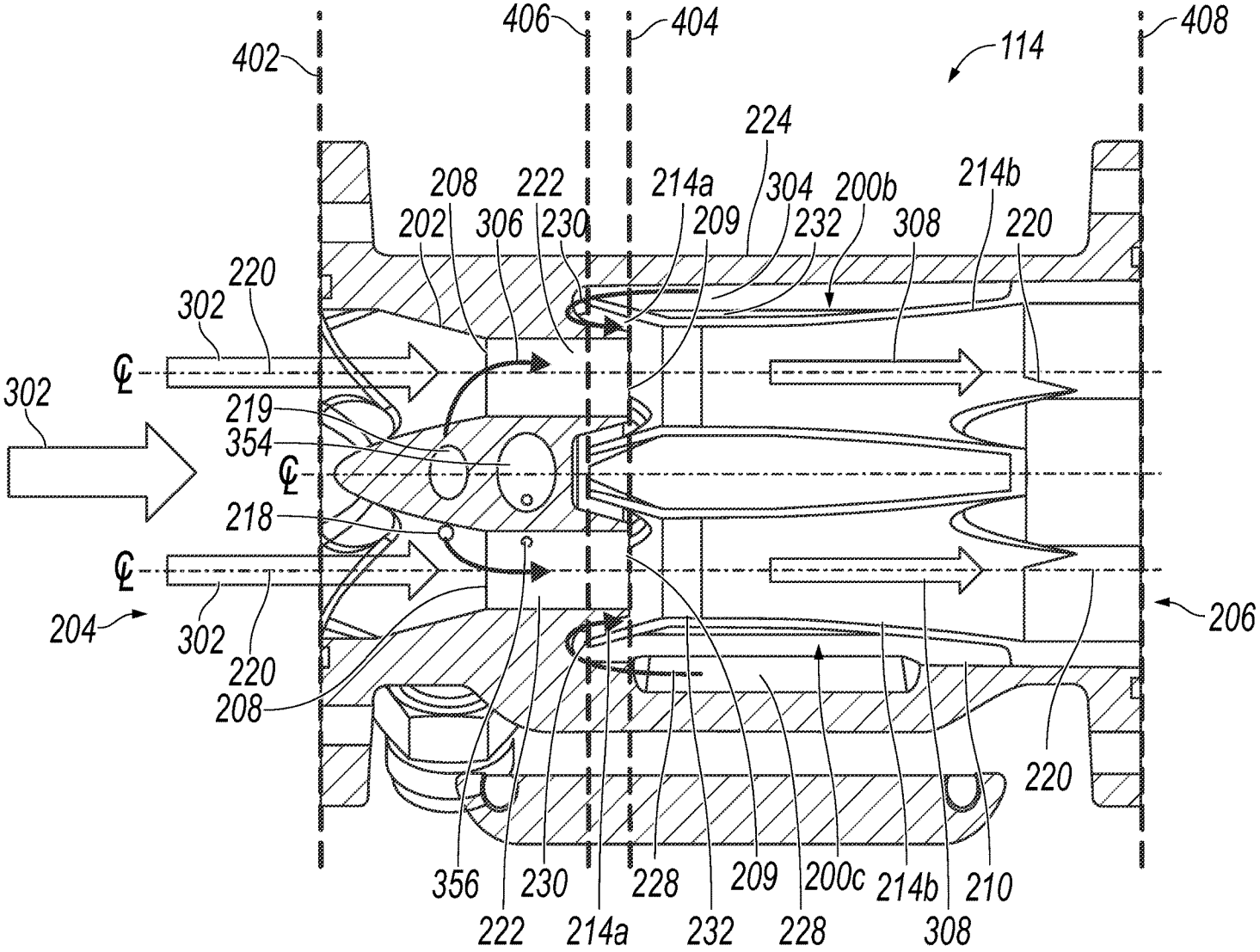
FIG. 3B is a half cross sectional view of the example exhaust gas recirculation mixer of FIG. 2. This view is 45° from the half cross sectional view shown in FIG. 3A.

FIG. 3A is a side half cross sectional view of the example exhaust gas recirculation mixer 114 of FIG. 2. In this illustration, barrels 200*a* and 200*c* are visible. FIG. 3B is a half cross sectional view of the example exhaust gas recirculation mixer of FIG. 2. This view is 45° from the half cross sectional view shown in FIG. 3A. In this illustration barrels 200*b* and 200*c* are visible. It should be noted that the fourth barrel, 200*d*, is not visible in the present figures, but is structurally similar to the other barrels described herein. The following description is provided in reference to both FIG. 3A and FIG. 3B unless otherwise specified.

The EGR mixer 114 is made up of one or more housings or casings. Openings in the end walls of the casings define an air inlet 204 and an outlet 206 of multiple interior flow passages 222, defined by each of the barrels 200. The interior flow passages 222 direct flow from the air inlet 204 to the outlet 206 to allow flow through the EGR mixer 114. Within a casing(s) 224, the EGR mixer 114 includes multiple convergent nozzles 202, each associated with a barrel 200, that define interior flow passages 222 in a flow path from an air inlet 204 of the EGR mixer 114 to an outlet 206 of the EGR mixer 114. The convergent nozzles 202 each converge toward the outlet of the EGR mixer 114. That is, each of the convergent nozzles 202 converge in the direction of flow toward a convergent end 208. That is, the downstream end (outlet) of the convergent nozzle 202 has a smaller cross-sectional area, i.e., a smaller flow area, than the upstream end (inlet) 226 of the convergent nozzle 202. In some implementations, the inlets 226 of the convergent nozzles 202 are in a same, first plane 402, and corresponding outlets of the convergent nozzles 202 are in a same, second plane 404. In other words, the components of each barrel 200 are aligned in parallel such that each component receives fluid flow in parallel with one-another within standard manufacturing tolerances.

The EGR mixer 114 includes an exhaust gas receiver housing 210 and the exhaust gas receiver housing 210 includes one or more exhaust gas inlets 212 fed from and fluidically connected to the EGR flow passages 108, and into an interior receiver cavity 228 of the exhaust gas receiver housing 210. In the illustrated implementation, the exhaust gas receiver housing 210 surrounds the convergent nozzles 202, such that a portion of the convergent nozzle 202 is within the interior receiver cavity 228. In some implementations, convergent-divergent nozzles 214 of each barrel 200 can be within the interior receiver cavity 228 as well. The convergent nozzles 202 are positioned to each form a free jet of gas out of the convergent end 208 of each nozzle 202. Also, the exhaust gas inlet 212 is upstream of an outlet 209, of each convergent nozzle 202. While the illustrated implementation shows an outlet 209 separate from a convergent end 208, other arrangements can be used, for example, the outlet 209 and the convergent end 208 can both be in the second plane 404 in some implementations. While the illustrated implementation shows the outlet 209 to extend (at least partially or entirely) within the exhaust gas receiver housing 210, other designs can be utilized. In some implementations, the air inlet 204 and the outlet 206 are provided with attachments or fittings to enable connection to the intake manifold 104 of the engine 102 and/or the EGR mixer 114. In some instances, the convergent nozzles 202 can be modularly interchangeable with convergent nozzles of different the inlet area 226 and convergent area 208, making the system readily changeable to fit multiple engine sizes. For example, the nozzles 202 can be provided with threads or another form of removable attachment to the remainder of the mixer casing 224. In some implementation, the convergent nozzles 202 can be integrated into the mixer casing 224 as a single, unitary piece.

Within each barrel 200, a convergent-divergent nozzle 214 is downstream of the convergent end 208 of a corresponding convergent nozzle 202 and is fluidically coupled to receive fluid flow from the outlet 206, the exhaust gas inlet 212, and, in certain instances, a fuel supply 216. In other words, the convergent-divergent nozzle 214 can act as an air-fuel-exhaust gas inlet for the intake manifold 104 (FIG. 1). The air-exhaust gas inlet 230 of each of the convergent-divergent nozzles 214 is in a same, third plane 406 that is perpendicular to the flow path. The corresponding outlet of each of the convergent-divergent nozzles 214 is in a same, fourth plane 408 that is perpendicular to the flow path and downstream of plane 402, plane 404, and plane 406. In other words, the components of each barrel are aligned in parallel such that each component receives fluid flow in parallel with one-another within standard manufacturing tolerances. To help facilitate mixing, an air-exhaust gas inlet 230 of each convergent-divergent nozzle 214 has a greater area than corresponding outlet 209. Each convergent-divergent nozzle 214 includes three parts: an air-exhaust gas inlet 230, a throat 232, and an outlet 206. The throat 232 is the narrowest point of each of the convergent-divergent nozzles 214 and is located and fluidically connected downstream of the air-exhaust gas inlet 230 of each of the convergent-divergent nozzles 214. The narrowing of the convergent-divergent nozzles 214 at the throat 232 increases a flow velocity of a fluid flow as it passes through each convergent-divergent nozzle 214. The outlet 206 of each of the convergent-divergent nozzles 214 is fluidically connected to and upstream of the intake manifold 104. Between the throat 232 and the outlet 206, the cross-section of the flow passage through the convergent-divergent nozzle 214 increases. The increase in cross-sectional area slows the flow velocity and increases the pressure of the fluid flow. In certain instances, the increase in cross-sectional area can be sized to increase a pressure within the EGR mixer 114 so that the pressure drop across the EGR mixer 114 is zero, nominal, or otherwise small. In some implementations, a divergent portion 214*b* of each of the convergent-divergent nozzles 214 diverges no more than 7°. The divergent portion 214*b* of each convergent-divergent nozzle 214 can diverge linearly or with a curve flaring outward. The convergent-divergent nozzle 214 can include threads or another form of removable attachment at the air-exhaust gas inlet 230, the outlet 206, or both to allow the convergent-divergent nozzle 214 to be installed and fluidically connected to the remainder of the intake of the engine system 100. Like the convergent nozzle 202, the convergent-divergent nozzle 214 can be modularly interchangeable with nozzles 214 of a different inlet 230, throat 232, and outlet 206 areas too make the system readily changeable to fit multiple engine sizes. In some implementation, multiple convergent-divergent nozzles 214 can be integrally formed into a single unitary piece.

In some implementations, the convergent nozzles 202 and the convergent-divergent nozzles 214 within each barrel 200 to be aligned at a same center axis 220, but in some implementations, the center axis 220 of the convergent nozzle 202 and the convergent-divergent nozzle 214 within each barrel 200 might not be aligned or parallel. For example, space constraints may require the EGR mixer 114 to have an angle between the axis of each of the convergent nozzles 202 and their corresponding convergent-divergent nozzles 214. In some implementations, rather than having a substantially straight flow passage as shown in FIGS. 3A-3B, the flow passage may be curved.

In some implementations, the fuel supply 216 includes a fuel manifold 219 and fuel supply ports 218 upstream of each of the convergent ends 208 of the convergent nozzles 202 within the air flow path. Each fuel supply port 218 is configured to supply fuel into the air flow path and upstream of a corresponding convergent nozzle 202. In some implementations, the fuel supply port 218 can be a gaseous fuel supply port, coupled to a source of gaseous fuel; however, the fuel delivered by the fuel supply port 218 can include any combustible fluid, such as natural gas, gasoline, or diesel. The fuel supply port 218 supplies a fuel flow 306 from a fuel manifold 219. Though illustrated with a single fuel port 218 within each barrel supplied by the common fuel manifold 219, separate, discrete fuel supplies with separate, discrete ports can be used with similar effect. While shown as a single port within each barrel, the fuel supply ports 218 can be configured in other ways, for example, as multiple fuel supply ports along the perimeter of each barrel, or in another manner. While the illustrated implementation shows a fuel supply port 218 configured to inject fuel upstream of the convergent end 208 of the convergent nozzle 202, fuel can also be added with a fuel supply port 218 upstream of the exhaust gas inlet 212. Such a port can include a gaseous fuel supply port.

A pressure port 356 is positioned downstream the convergent portion 203 of each of the convergent nozzles 202. The pressure port 356 provides a location to sense pressure downstream of a convergent end 208 of each of the convergent nozzles 202 by allowing fluid communication between the interior flow passage 222 and a common pressure sensing manifold 354. A pressure sensor 352 senses a pressure within the common pressure sensing manifold 354 and sends a signal to the controller 130 indicative of the pressure within the common pressure sensing manifold 354. Though illustrated with a single sensor on a common manifold, separate, discrete sensors with separate, discrete ports can be used with similar effect. Alternatively or in addition, a virtual sensor can be used in lieu of a discrete sensor. That is, the pressure can be calculated based on the known geometry of the convergent nozzles and other information received from various sensors throughout the system.

The pressure sensed by the pressure sensor 352 can be compared to a sensed pressure elsewhere either upstream or downstream of the EGR mixer 114 to determine a differential pressure. The determined differential pressure can be used to determine a mass air-flow (MAF) rate passing through the EGR mixer 114. In certain instances, such a calculation can be performed by the controller 130 (FIG. 1). The MAF rate can be used as an input for the controller to adjust a variety of parameters within the engine system 100. In certain instances, the controller 130 is an engine control unit (ECU) that controls some or all aspects of the engine system 100 operations, such as fuel supply, air, ignition and/or other engine operational parameters. In certain instances, the controller 130 is a separate control unit from the engine system's ECU. The controller 130 also need not send actuation and/or control signals to the engine system 100, but could instead provide information, such as the MAF and EGR flow rates, to an ECU for use by the ECU in controlling the engine system 100.

Figure 4:
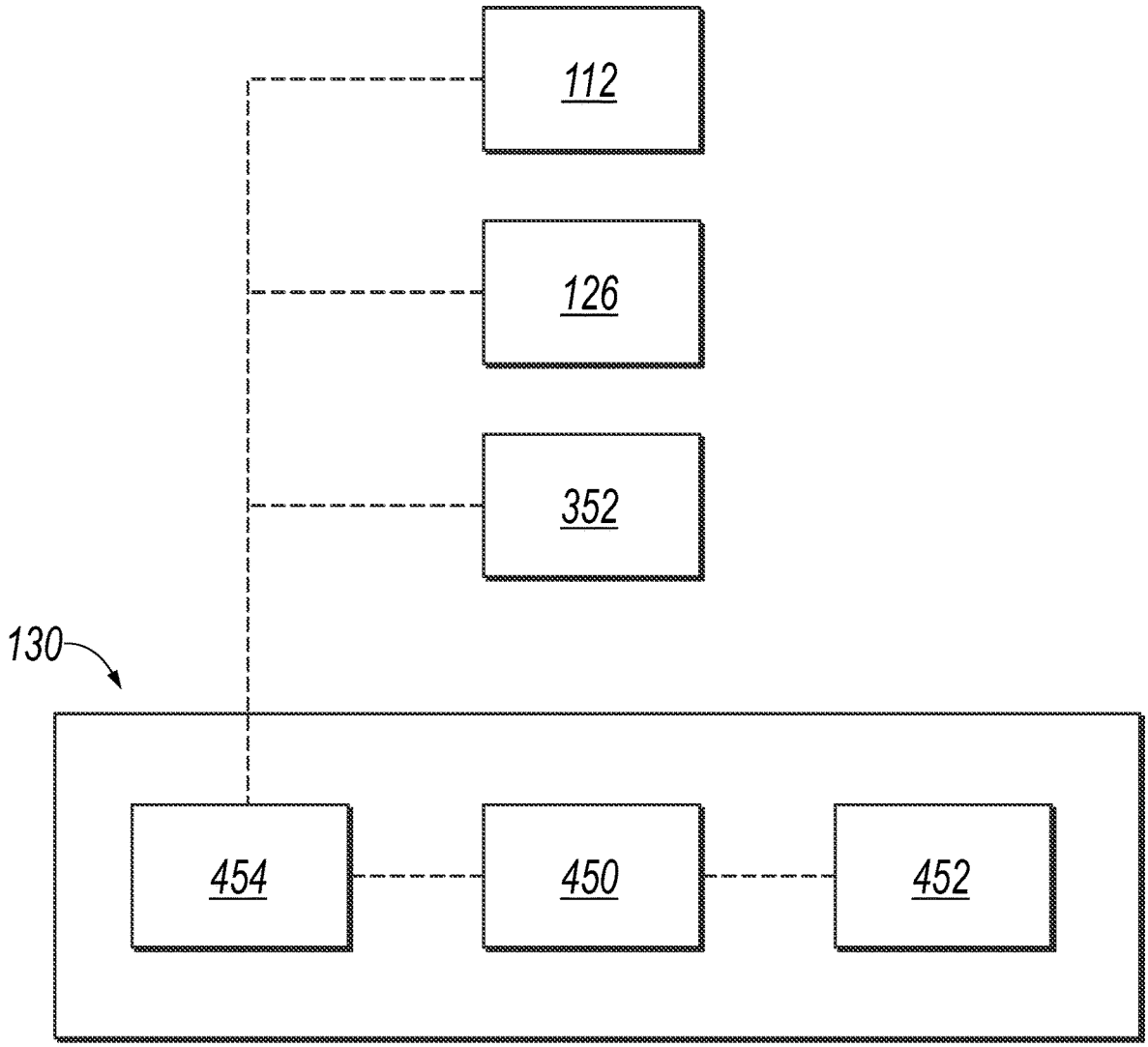
FIG. 4 is a block diagram of an example controller that can be used with aspects of this disclosure.

FIG. 4 is a block diagram of an example controller 130 that can be used with aspects of this disclosure. The controller 130 can, among other things, monitor parameters of the system and send signals to actuate and/or adjust various operating parameters of the system. As shown in FIG. 4, the controller 130 can include one or more processors 450 and non-transitory storage media (e.g., memory 452) containing instructions that cause the processors 450 to perform operations described herein. The processors 450 are coupled to an input/output (I/O) interface 454 for sending and receiving communications with components in the system, including, for example, the pressure sensor 352. In certain instances, the controller 130 can additionally communicate status with and send actuation and/or control signals to one or more of the various system components (including the throttle 112 and the EGR throttle valve 126) of the engine system 100, as well as other sensors (e.g., pressure sensors, temperature sensors, knock sensors, and other types of sensors) provided in the engine system 100.

The illustrated implementation operates as follows. The first set of convergent nozzles 202 each increase a velocity and decrease a pressure of a portion of an air flow 302 in the EGR mixer 114 to form multiple free jets exiting a corresponding convergent nozzle 202. An exhaust flow 304 is drawn into the EGR mixer 114 through the exhaust gas inlet 212 in response to (e.g., because of) the decreased pressure of each of the free jet air flows 302 exiting the convergent nozzles 202. The exhaust flow 304 is directed from the exhaust manifold 106 eventually to the point downstream of the convergent nozzles 202. The air flow 302, the exhaust flow 304, and a fuel flow 306 are mixed to form multiple mixed flows 308 that act as a combustion mixture. The mixed flows 308 are mixed with a second set of convergent nozzles 214*a* positioned downstream of the corresponding first convergent nozzles 202. Each of the second set of convergent nozzles 214*a* corresponds to a different one of the first set of convergent nozzles 202. A pressure of each of the mixed flows is increased, and a velocity of each of the mixed flows 308 is reduced with a set divergent nozzles 214*b* each corresponding to a different one of the second of convergent nozzles 214*a*. While each of the second set of convergent nozzles 214*a* and each of the set of divergent nozzles 214*b* are illustrated as unitary convergent-divergent nozzles 214, each of the second set of convergent nozzles 214*a* and each of the set of divergent nozzles 214*b* can be separate and distinct parts.

In the illustrated implementation, the fuel flow 306 is supplied into the air flow 302 with a fuel supply port 218 located on the side of each of the convergent nozzles 202. The fuel flow 306 is supplied upstream of the convergent end 208. In some implementations, the fuel flow 306 is supplied into the exhaust flow 304 with a fuel supply port 218. Regardless of the implementation used, the fuel flow 306 can include a gaseous fuel flow.

While this disclosure contains many specific implementation details, these should not be construed as limitations on the scope of what may be claimed, but rather as descriptions of features specific to particular implementations of particular inventions. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. An engine exhaust gas recirculation mixer, the mixer comprising:

a plurality of convergent nozzles defining a plurality of flow passages that extend alongside one another in a flow path from an engine intake air inlet of the mixer to an outlet of the mixer, the plurality of convergent nozzles each converging toward the outlet of the mixer;

an exhaust gas receiver housing comprising an exhaust gas inlet into an interior of the exhaust gas housing; and a plurality of convergent-divergent nozzles in the flow path each corresponding to one of the plurality of convergent nozzles, the plurality of convergent-divergent nozzles extending alongside one another, the plurality of convergent-divergent nozzles each comprising an air-exhaust gas inlet in fluid communication to receive fluid flow from a corresponding convergent nozzle and the interior of the exhaust gas housing, where each one of the air-exhaust gas inlets is upstream of a corresponding outlet of one the plurality of convergent nozzles.

2. The engine exhaust gas recirculation mixer of claim 1, wherein inlets of each of the convergent nozzles being in a same, first plane perpendicular to the flow path, and corresponding outlets of the convergent nozzles being in a same, second plane perpendicular to the flow path.

3. The engine exhaust gas recirculation mixer of claim 1, wherein the air-exhaust gas inlet of each of the convergent-divergent nozzles being in a same, third plane perpendicular to the flow path, and the corresponding outlet of each of the convergent-divergent nozzles being in a same, fourth plane perpendicular to the flow path.

4. The engine exhaust gas recirculation mixer of claim 1, where each of the convergent-divergent nozzles are aligned on a same center axis as a corresponding convergent nozzle.

5. The engine exhaust gas recirculation mixer of claim 1, where the plurality of convergent nozzles extend within the exhaust gas housing.

6. The engine exhaust gas recirculation mixer of claim 1, where each of the air-exhaust gas inlets has a greater area than the corresponding outlet of the corresponding one of the plurality of convergent nozzles.

7. The engine exhaust gas recirculation mixer of claim 1, where the plurality of convergent nozzles comprise four convergent nozzles and the plurality of convergent-divergent nozzles comprise four corresponding convergent-divergent nozzles.

8. The engine exhaust gas recirculation mixer of claim 1, where a divergent portion of the convergent-divergent nozzle diverges no more than 7°.

9. An engine exhaust gas recirculation mixer, the mixer comprising:

a plurality of convergent nozzles defining a plurality of flow passages that extend alongside one another in a flow path from an engine intake air inlet of the mixer to an outlet of the mixer, the plurality of convergent nozzles each converging toward the outlet of the mixer;

a fuel supply port positioned downstream of an inlet to the plurality of convergent nozzles;

an exhaust gas housing comprising an exhaust gas inlet into an interior of the exhaust gas housing; and a plurality of convergent-divergent nozzles in the flow path each corresponding to one of the plurality of convergent nozzles, the plurality of convergent-divergent nozzles extending alongside one another, the plurality of convergent-divergent nozzles each comprising an air-exhaust gas inlet in fluid communication to receive fluid flow from a corresponding convergent nozzle and the interior of the exhaust gas housing, where the air-exhaust gas inlet of each of the plurality of convergent-divergent nozzles is an air-fuel-exhaust gas inlet in communication with the fuel supply port into the mixer.

10. The engine exhaust gas recirculation mixer of claim 9, where the fuel supply comprises:

the fuel supply port positioned upstream of the convergent-divergent nozzle.

11. The engine exhaust gas recirculation mixer of claim 10, where the fuel supply port comprises a gaseous fuel supply port.

12. An engine exhaust gas recirculation mixer, the mixer comprising:

a plurality of convergent nozzles defining a plurality of flow passages that extend alongside one another in a flow path from an engine intake air inlet of the mixer to an outlet of the mixer, the plurality of convergent nozzles each converging toward the outlet of the mixer;

an exhaust gas receiver housing comprising an exhaust gas inlet into an interior of the exhaust gas housing; and a plurality of convergent-divergent nozzles in the flow path each corresponding to one of the plurality of convergent nozzles, the plurality of convergent-divergent nozzles extending alongside one another, the plurality of convergent-divergent nozzles each comprising an air-exhaust gas inlet in fluid communication to receive fluid flow from a corresponding convergent nozzle and the interior of the exhaust gas housing;

a plurality of pressure ports at a convergent end of each of the plurality of convergent nozzles.

13. A method comprising:

increasing a velocity and decreasing a pressure of an engine intake air flow using a first plurality of convergent nozzles to form a plurality of free jets exiting a corresponding one of the plurality of converging nozzles;

drawing an engine exhaust flow, in response to the decreased pressure of each of the plurality of free jets, downstream of the first plurality of convergent nozzles;

mixing, using a second plurality of convergent nozzles downstream of the first plurality of convergent nozzles, the each of the plurality of free jets and the exhaust flow to form a plurality of mixed flows corresponding to the plurality of free jets, each of the second plurality of convergent nozzles corresponding with a different one of the first plurality of convergent nozzles, where each one of the air-exhaust gas inlets is upstream of a corresponding outlet of one the plurality of convergent nozzles; and increasing a pressure and reducing a velocity of the plurality of mixed flows using a plurality of divergent nozzles each corresponding to a different one of the second plurality of convergent nozzles.

14. The method of claim 13, where mixing one of the plurality of free jets and the exhaust flow to form one of the pluralities of mixed flows comprises mixing a portion of the air flow, a portion of the exhaust flow, and a portion of a fuel flow, to form a combustion mixture.

15. The method of claim 14, comprising supplying the fuel flow upstream of the convergent ends of the first plurality of convergent nozzles.

16. The method of claim 14, where the fuel flow comprises a gaseous fuel flow.

17. The method of claim 13, comprising directing the exhaust flow from an exhaust manifold to a point downstream of the first plurality of convergent nozzles.

18. An engine system comprising:

an engine intake manifold configured to receive a combustible mixture configured to be combusted within an engine combustion chamber;

a throttle upstream of the intake manifold, the throttle configured to regulate an air flow into the intake manifold;

an exhaust manifold configured to receive combustion products from the combustion chamber; and an exhaust gas recirculation mixer downstream of the throttle and upstream of the intake manifold, the exhaust gas recirculation mixer comprising:

a plurality of convergent nozzles that extend alongside one another defining a plurality of flow passages in a flow path from an engine air intake air inlet of the mixer to an outlet of the mixer, the plurality of convergent nozzles each converging toward the outlet of the mixer;

an exhaust gas receiver housing comprising an exhaust gas inlet into an interior of the exhaust gas housing; and a plurality of convergent-divergent nozzles in the flow path each corresponding to one of the plurality of convergent nozzles, the plurality of convergent-divergent nozzles extending alongside one another, the plurality of convergent-divergent nozzles each comprising an air-exhaust gas inlet in fluid communication to receive fluid flow from a corresponding convergent nozzle and the interior of the exhaust gas housing where each one of the air-exhaust gas inlets is upstream of a corresponding outlet of one the plurality of convergent nozzles.

19. The engine system of claim 18, comprising a compressor upstream of the throttle, the compressor configured to increase a pressure within the flow path.

20. The engine system of claim 19, comprising a turbine downstream of the exhaust manifold, the turbine being coupled to the compressor and configured to rotate the compressor.

21. The engine system of claim 19, comprising an exhaust gas cooler positioned within a flow path between the exhaust manifold and the exhaust gas recirculation mixer, the exhaust gas cooler configured to lower a temperature of the exhaust gas prior to the exhaust gas recirculation mixer.

* * * * *